US005320299A

United States Patent [19]

Fitzpatrick et al.

[11] Patent Number: 5,320,299

[45] Date of Patent: Jun. 14, 1994

[54] ARTICULATED RIDER ROLL SYSTEM AND METHOD

[75] Inventors: Donald C. Fitzpatrick, Chatham, N.Y.; Kenneth G. Frye, South Egremont, Mass.; Donald Gangemi, Great Barrington, Mass.; Alexis Olshansky, Becket, Mass.

[73] Assignee: Beloit Technologies, Inc., Wilmington, Del.

[21] Appl. No.: 825,684

[22] Filed: Jan. 27, 1992

[51] Int. Cl.[5] ..... B65M 18/26

[52] U.S. Cl. ..... 242/066

[58] Field of Search ..... 242/65, 66

[56] References Cited

U.S. PATENT DOCUMENTS

| | | | |
|---|---|---|---|
| 3,232,549 | 2/1966 | Stambaugh | 242/66 |
| 3,237,877 | 3/1966 | Printz et al. | 242/66 |
| 3,599,889 | 8/1971 | Pfeiffer | 242/66 |
| 3,604,649 | 9/1971 | Dörfel | 242/66 |
| 3,648,342 | 3/1972 | Dörfel | 29/125 |
| 3,837,593 | 9/1974 | Dörfel | 242/66 |
| 3,858,820 | 1/1975 | Crouse | 242/66 |
| 3,937,410 | 2/1976 | Justus | 242/66 |
| 4,095,755 | 6/1978 | Snygg et al. | 242/66 |
| 4,171,106 | 10/1979 | Crouse | 242/66 |
| 4,434,949 | 3/1984 | Karr | 242/66 |
| 4,469,286 | 9/1984 | Greding | 242/65 |
| 4,472,155 | 9/1984 | Greding | 464/73 |
| 4,496,112 | 1/1985 | Olsson et al. | 242/66 |
| 4,541,585 | 9/1985 | Frye et al. | 242/66 |
| 4,550,887 | 11/1985 | Schonmeier | 242/65 X |
| 4,811,915 | 3/1989 | Smith | 242/66 |

FOREIGN PATENT DOCUMENTS

| | | | |
|---|---|---|---|
| 2147673 | 3/1973 | Fed. Rep. of Germany . | |
| 2439212 | 2/1976 | Fed. Rep. of Germany . | |
| 3627463 | 2/1988 | Fed. Rep. of Germany . | |
| 60-157441 | 8/1985 | Japan . | |
| 1180302 | 2/1970 | United Kingdom | 242/66 |
| 2018728 | 10/1979 | United Kingdom | 242/66 |

*Primary Examiner*—Daniel P. Stodola
*Assistant Examiner*—John P. Darling
*Attorney, Agent, or Firm*—Dirk J. Veneman; Raymond W. Campbell; Gerald A. Mathews

[57] ABSTRACT

A rider roll system for exerting an even nip load force along the surface of a roll of paper being wound from a continuous on-coming web in a winder comprises a plurality of rider roll wheel elements, each of which is connected to a common source of hydraulic pressure to provide the same rolling nip force against the wound paper roll. The rider roll wheel elements are mounted to a beam which is translationally movable above the wound paper roll. The beam and individual rider roll wheel elements are moved upwardly as a function of the increase in the diameter of the wound paper roll. The relationship of the beam movement relative to the diameter of the wound paper roll is controlled by a programmable logic controller. The individual wheel elements are loaded against a counter-balance force so as to provide equal, but cushioned, nip force against the surface of the wound paper roll at short intervals along its length. The magnitude of the evenly applied nip load force is also controlled as a function of the wound paper roll diameter.

16 Claims, 6 Drawing Sheets

I/P
P/I
N

ARTICULATED RIDER ROLL SYSTEM AND METHOD

BACKGROUND OF THE INVENTION

1. Field of the Invention

This invention relates to the winding of a continuous web of material, such as paper manufactured on a papermaking machine. More particularly, this invention relates to the construction and control of a rider roll for applying pressure to a roll of paper being wound in a winder. Still more particularly, this invention relates to an articulated rider roll system comprising a multiple number of axially aligned individual wheel elements for applying a controlled nip force against the surface of a roll of paper being wound by controlling the movement of a beam on which the wheel elements are mounted, and against which they are biased, and the nip load force, both as a function of the paper roll diameter.

2. Description of the Prior Art

Rider rolls for stabilizing and controlling wound-in tension in the paper web in a winder have been used almost since the invention of the winder itself. The dynamics of winding an on-coming web of paper into a wound paper roll, which may be 30 feet long and 6 feet in diameter, requires careful support and pressure to maintain the wound-in web tension at desired levels at different radial distances in the diameter of the wound roll. Also important is the function of nip mechanics of the rider roll against the surface of the wound roll to provide the desired density of the wound roll while maintaining the desired web tension. Nip mechanics has been defined as a strain inducing mechanism that increases the sheet tension in the outside layers of a paper roll beyond the unwind stand tension.

The tension in the paper web at the rider roll nip controls the relative slippage between the first few layers of paper. After the paper web has been covered with several layers of on-coming paper, the wound-in tension at the surface has an effect on the paper previously wound, so it is important that the initial wound-in tension be controlled and correct for the diameter of the roll at each stage in its development.

Prior rider roll configurations have included a continuous metal roll extending across the entire working width of a winder, which essentially corresponds to the length of the paper roll being wound. As winder speeds increased, and as the length of the wound paper roll increased, improvements were made in the support provided by the rider roll by biasing the rider roll pneumatically against the wound paper roll (Printz et al, U.S. Pat. No. 3,237,877), and by forming the rider roll into segments extending axially across the width of the winder so that separate segments could have their ends separately biased to follow the contour of the paper roll being wound (Dörfel, U.S. Pat. No. 3,648,342 and Snygg et al, U.S. Pat. No. 4,095,755). Also known is the use of inflatable support drums and rider roll (Frye et al, U.S. Pat. No. 4,541,585) in a winder for the purpose of distributing the forces supporting the wound paper roll over a wider area to avoid crushing of the paper web and to distribute the wound-in web tension more evenly.

All of these apparatus provide some improvement in the support and distribution of the forces provided by the rider roll against the surface of the wound paper roll along its length. However, all of these prior systems have a common structural and operational deficiency in that the forces they provide by the rider roll against the wound paper roll vary in intensity across the machine width due to variations in paper profile in the cross-machine direction.

As a result of the variable nip force with which the rider roll in prior apparatus engages the surface of the wound paper roll, and considering that the localized diameter of the wound roll varies at different locations along the length of the roll due to variations in the caliper of the paper web, roll defects are caused or exacerbated by high localized nip loads where the diameter of the wound roll is slightly larger than the diameter of the roll at a location a short distance away along the longitudinal axis of the wound roll. Thus, local variations in the wound roll diameter, which themselves are undesirable, contribute to other defects, such as variations in the wound-in web tension by preventing continuous and uniform contact of other locations closely spaced along the length of the wound roll surface by the rider roll which is held away from the relatively lower surface areas of the wound paper roll by its contact over the relatively higher surface areas over the points of slightly greater localized diameters on the wound roll.

SUMMARY OF THE INVENTION

The problems and deficiencies of prior rider roll systems in papermaking machine winders have been obviated by this invention. In this system, the rider roll comprises a plurality of articulated, axially aligned, relatively narrow wheel elements which are individually mounted to a beam over the paper roll being wound. Each of the wheel elements has a relatively soft cover comprised of an elastomeric compound, such as urethane or rubber. In addition, each of the wheel elements is individually biased relative to the beam against a short length of the roll surface corresponding to the width of the wheel element. Each of the wheel elements is biased against the wound roll by equal pressure from a common hydraulic manifold so as to provide substantially equal, continuous nip force by the composite rider roll along the entire surface of the paper roll being wound.

This arrangement of articulated rider roll wheel elements provides continuous nip support against a whole set of axially aligned, relatively short length wound rolls which are formed when the on-coming paper web has been longitudinally slit so as to form a plurality of such short length rolls which together form the composite wound paper roll on the winder. In the event that roll tumble, or throwout, occurs, or tries to occur, in one or more of the short length wound rolls due to uneven cross-machine web caliper profile, the individually biased rider roll wheel elements, having a relatively short axial length, maintain contact with each such short length wound roll to maintain all of them in position against the support drum, or drums. This greatly assists in reducing instability due to wound roll rocking from any operating excitation frequency.

In this invention, there are two basic control arrangements—single loop control and double loop control. Both arrangements utilize parameters generated by the control algorithm, the pressure set point and the position set point.

A predefined nip load profile is calculated by the control algorithm relative to the roll diameter. The pressure values corresponding to diameter values along this profile are considered to be the instantaneous pressure set point.

The controller monitors the roll diameter continuously, and that diameter may be arrived at by sensing the position of the center of rotation of the wound roll (core chuck position), or by counting wound roll revolutions and drum revolutions, calculating the roll diameter from that information, or by any other method which yields acceptably accurate roll diameter information. From the roll diameter the controller computes the desired rider roll beam position known as the position set point.

Both set points are variable and are functions of wound roll diameter.

Individual wheel elements are pivotally mounted to enable them to rotate about an axis offset from a substantially vertical plane in which the translational movement of the longitudinal axis of the wound roll is located. The rider roll wheel elements are loaded with an equal hydraulic pressure from their common hydraulic manifold. Equal rider roll nip load is thereby applied equally along the longitudinal length of the paper roll being wound regardless of localized variations in wound roll diameter caused by variations in paper web caliper. Since the individual wheel elements comprising the composite rider roll are biased with equal pressure, and such biasing pressure is maintained for substantially the entire arcuate path of travel which each wheel element is capable of traveling relative to its mounting on the beam, the nip force provided by the rider roll wheel elements is substantially constant along the entire longitudinal length of the wound paper roll when the pivot arms on which the wheel elements are mounted are maintained at substantially right angles to an imaginary plane parallel to the translational direction of movement of the paper roll axis of rotation, and are not allowed to reach the mechanical limit of their respective arcuate travel ranges.

In the single loop control arrangement, the rider roll beam is brought to an initial position over the bare core such that the individual rider roll wheel elements are all approximately at the middle of their range of travel. The hydraulic manifold is filled with fluid, and the valve is closed.

As the wound roll builds up, the hydraulic pressure is maintained in a narrow band around the pressure set point. This is accomplished in the following manner.

As the paper begins to build up on the wound roll, the diameter increases, forcing the individual wheel elements upward towards the beam. As the beam is not moving, the pressure increases in the hydraulic manifold. The controller monitors the hydraulic pressure continuously, and when the pressure reaches the upper limit of the control band, the controller moves the beam incrementally upward until the hydraulic pressure drops to the lower limit of the control band. The process is then repeated. In this case, the pressure or rider roll load is controlled in closed loop fashion by positioning the beam.

In the double loop control arrangement, the rider roll beam is brought to an initial position over the bare core such that the individual rider roll wheel elements are all approximately at the middle of their range of travel. The hydraulic manifold is filled with fluid and pressurized at the pressure set point. The valve remains open, and the pressure is maintained at the pressure set point by an external supply mechanism. This pressure control may be open or closed loop.

As the wound roll builds up, the rider roll beam position is maintained in a narrow band around the position set point. This is done by sensing the beam position and comparing it to the computed position set point. The resulting error signal causes the rider roll beam to move incrementally upward maintaining its position relative to the top of the wound roll.

Accordingly, this invention provides continuous and substantially constant rider roll nip load force along the entire surface of the paper roll being wound continuously while the diameter of the wound paper roll is increasing. As described in the preceding paragraph, the cyclic loading, within the control band, of the rider roll against the wound paper roll has been reduced to the point of inconsequence. The time interval and adjustment distance traveled by the beam are functions of the system resolution and are made to be as minute as to provide essentially continuous operation and beam movement.

The nip load force of the wheel elements is thus controlled and varied as a function of the paper roll diameter which, in turn, affects the wound-in web tension required to wind a paper roll having fewer defects, such as bursting and wrinkling.

Accordingly, it is an object of this invention to provide a rider roll system for a winder wherein a beam has a plurality of rider roll wheel elements mounted to it and biased against it to provide nip loading force against a paper roll being wound, and the beam position and nip loading force are adjustable as a function of the diameter of the paper roll being wound.

Another object of this invention is to provide a rider roll system for a winder wherein the diameter of the paper roll being wound is constantly monitored, and a beam has a plurality of rider roll wheel elements mounted to it and biased against the paper roll and the hydraulic pressure producing the nip force of the rider roll wheel elements on the paper roll is monitored and compared with a pre-programmed profile and varied as a function of the diameter of the paper roll.

Still another object of this invention is to provide a rider roll system for a winder wherein the rider roll nip load against the paper roll being wound is provided uniformly along the paper roll surface by a plurality of substantially axially aligned rider roll wheel elements which are loaded with substantially the same hydraulic pressure so as to produce the desired uniform action of nip mechanics in the paper roll.

Yet another object of this invention is to provide a rider roll system for a winder wherein the diameter of the wound paper roll is constantly monitored and the winder beam has a plurality of rider roll wheel elements mounted to it which are actuated with the same hydraulic pressure to provide uniform rider roll nip load across the wound paper roll, wherein the hydraulic pressure on the rider roll wheel elements is varied as a function of the wound paper roll diameter.

Still another object of this invention is to provide a rider roll system for a winder wherein the diameter of the wound paper roll is constantly monitored and the winder beam has a plurality of rider roll wheel elements mounted to it which are loaded with a constant amount of hydraulic fluid and pressure to provide a uniform rider roll nip load across the wound paper roll, wherein the rider roll nip load is provided and varied by movement of the winder beam as a function of the wound paper roll diameter.

An object, feature and advantage of this invention is the ability to provide in a winder substantially equal and continuous rider roll nip loading force against substantially the entire surface length of the paper roll being wound while accommodating variations in the diameter of the paper roll longitudinally along its length.

Another object, feature and advantage of this invention is its ability to provide in a winder a substantially constant rider roll nip loading force along the entire length of the paper roll being wound, and to vary the rider roll nip loading force by substantially the same amount along the entire length of the wound paper roll as a function of the increase in the wound paper roll diameter.

These, and other objects, features and advantages of this invention will become more readily apparent to those skilled in the art upon reading the description of the preferred embodiments in conjunction with the attached drawings.

DESCRIPTION OF THE PREFERRED EMBODIMENTS

Figure 2:
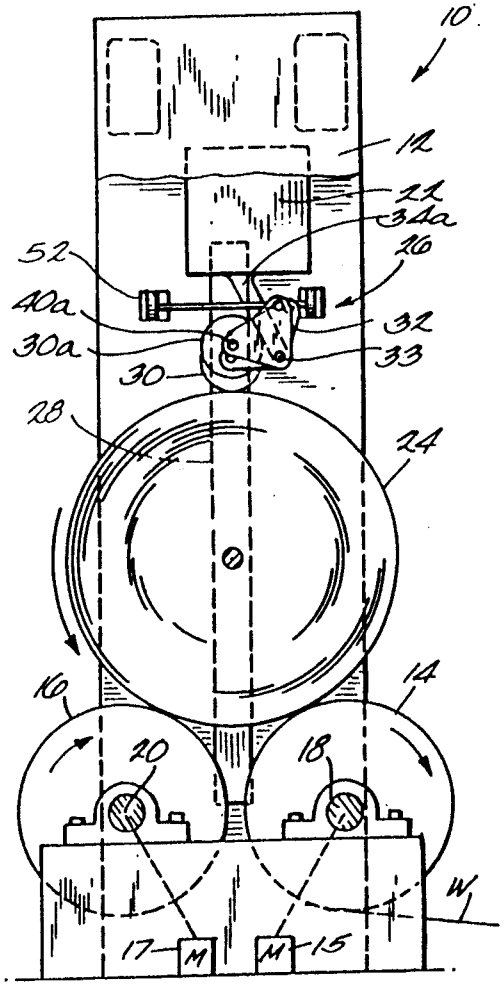
FIG. 2 is an end-elevational view of the winder shown in FIG. 1 and showing the pivotal mounting of a rider roll wheel element.
Figure 1:
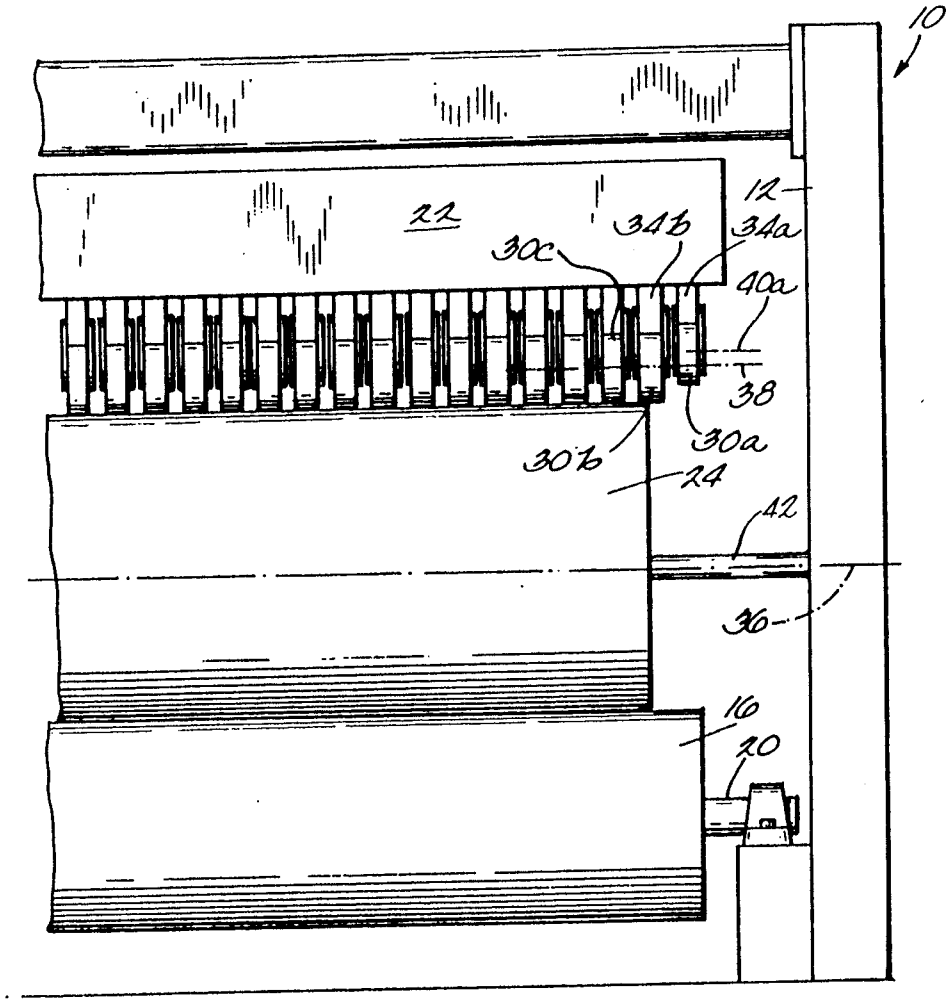
FIG. 1 is a front-elevational view of a winder showing the rider roll beam and the plurality of rider roll wheel elements.

With reference to FIGS. 1 and 2, a winder, generally designated by the numeral 10, includes a frame 12 in which a pair of horizontally spaced drums 14,16 are rotatably mounted about their corresponding axles 18,20 in bearing housings. Since each side of the winder is substantially identical, FIG. 1 only shows half of the winder, but it is understood that the other half is substantially identical and includes the motors 15,17 for driving the support drums 14,16. A support beam 22 is disposed within the winder frame for translational movement vertically relative to the roll of paper 24 being wound from an on-coming endless paper web W as it is supported on the rotatably driven winder drums 14,16.

Figure 4:
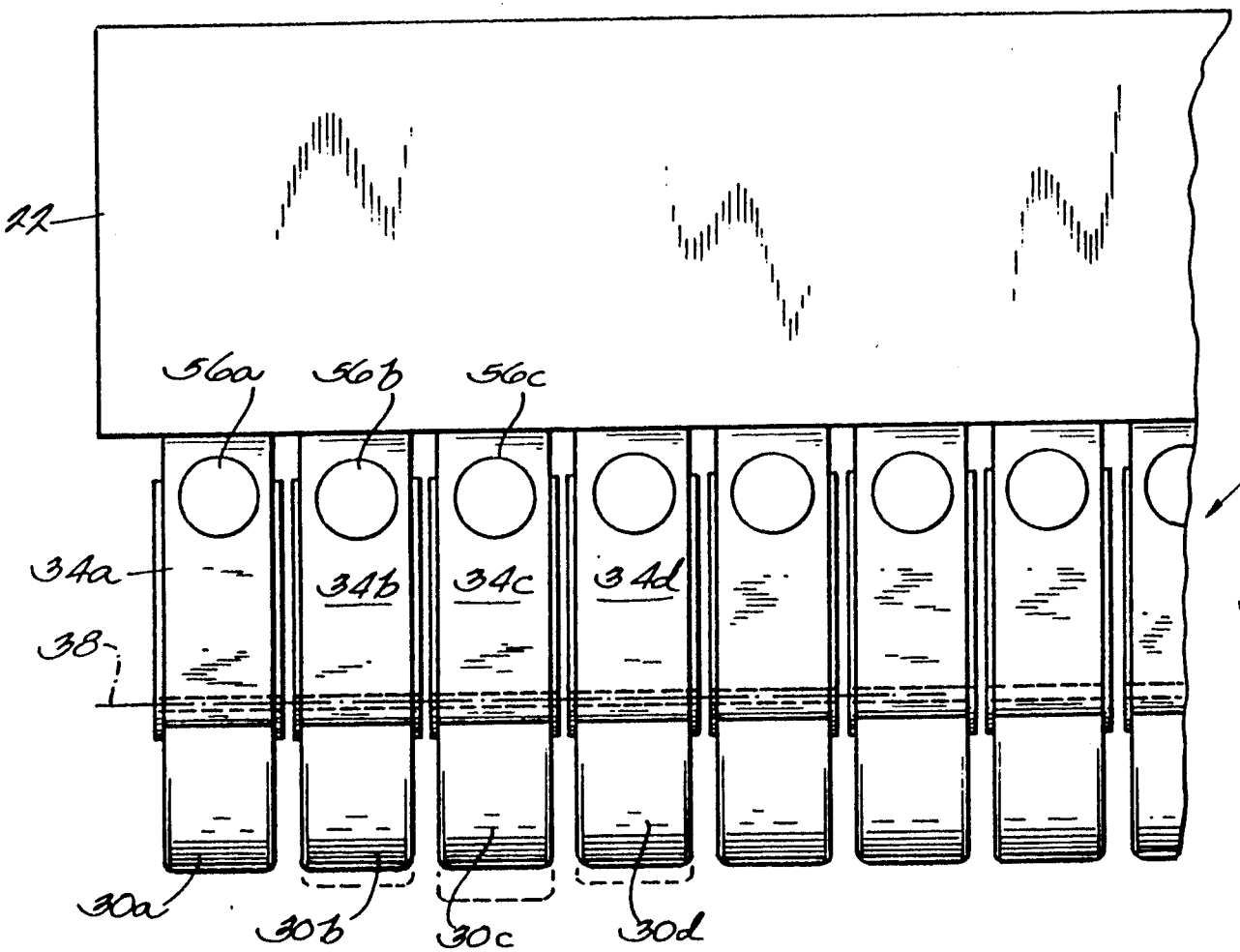
FIG. 4 is a rear-elevational view of a portion of the rider roll support beam and showing the hydraulic cylinders for actuating the pivotal movement of the individual rider roll wheel elements.
Figure 5:
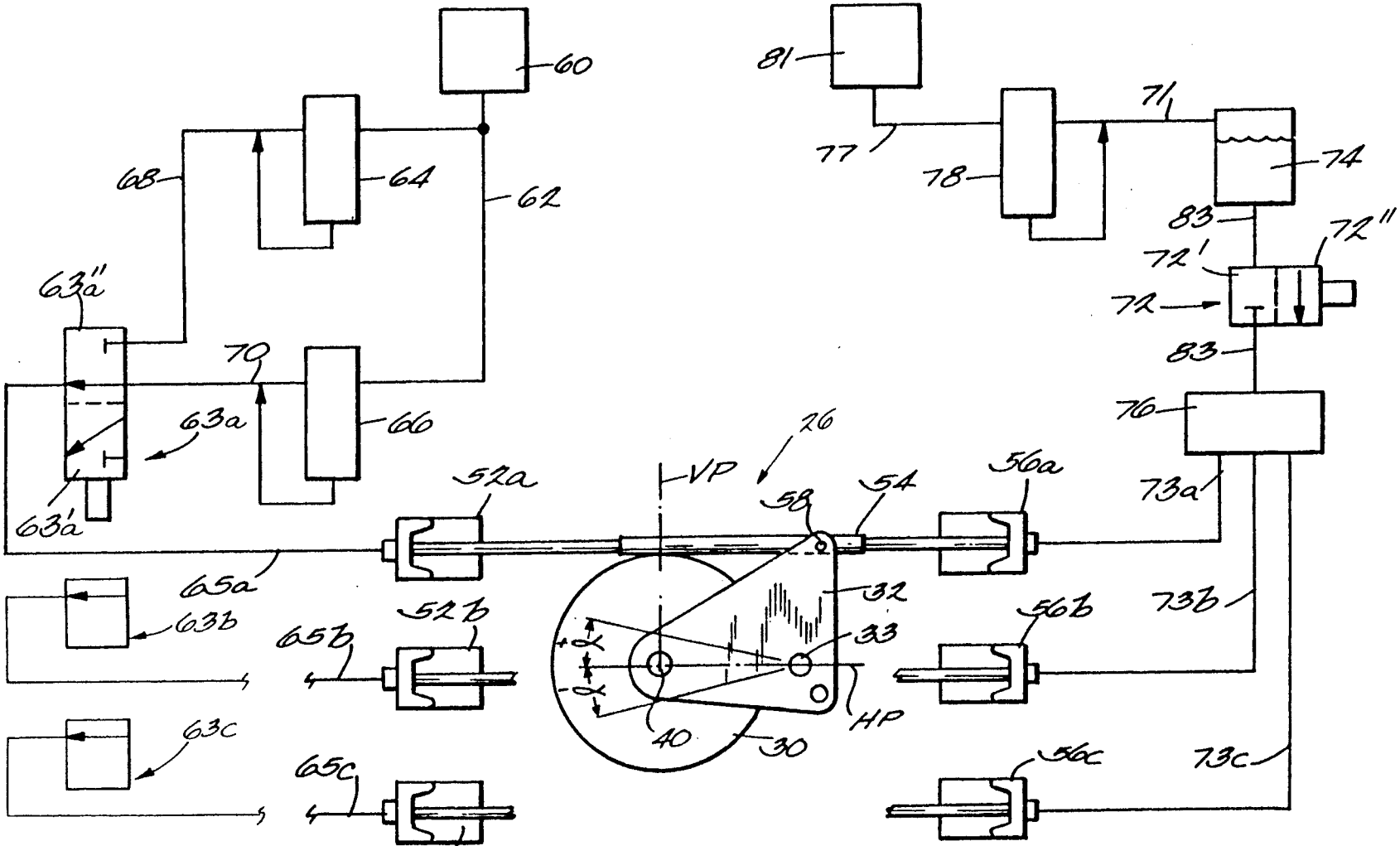
FIG. 5 is a side view, somewhat schematic in form, showing an embodiment of a pivoted rider roll wheel element wherein a counter balance pneumatic chamber is disposed on the arm actuating the pivotal motion of the wheel element under the nip loading pressure of a hydraulic cylinder.

With additional reference to FIGS. 4 and 5, a rider roll assembly, generally designated with the numeral 26, as is also shown in FIG. 2, is mounted to the beam above the paper roll 24. The rider roll assembly includes a plurality of individual wheels **30*a*,30*b*,30*c*,30*d*, etc., which are rotatably mounted in corresponding individual pivot arms 32*a*,32*b*,32*c*,32*d*, etc., which are pivotally mounted to corresponding individual brackets 34*a*,34*b*,34*c*,34*d*, etc., mounted to the beam. The wheel elements are operationally disposed at the ends of their respective pivot arms such that, at their nominal position intermediate the extremes of their pivotal travel in either direction, their axes of rotation are parallel with, and aligned substantially vertically in a plane with the axis of rotation 36 of the wound paper roll. No wheel element is disposed over a slit between sections of the wound roll. If the wound paper roll were a perfect cylinder, such as shown in FIG. 2, the individual axes of rotation of the individual wheel elements would be co-aligned along an imaginary axis of rotation 38 of the composite rider roll, such as shown in FIGS. 1, 2 and 4. Note that the axis 40*a* of wheel element 30*a* shown in FIG. 1 is offset from the nominal axis of rotation 38 of the composite rider roll due to the fact that the wheel element 30*a* has rotated upwardly about its pivot due to the fact that it is not supported on the surface of the wound paper roll 24 and has been rotated upwardly out of the way by a counter-balancing piston 52, which is shown in FIG. 2**.

The core chuck 42 supporting each end of the paper roll 24 is rotatably supported in a core slide 28, such as indicated schematically in FIG. 2, for rotational support and guidance in the winder frame in a manner well-known to those skilled in the art. The manner in which the paper roll is rotatably supported, and the support beam is translationally supported and movable, in the winder is not part of this invention and, therefore, will not be described in detail.

The pivot of each of the individual wheel elements comprising the composite rider roll assembly is disposed at substantially right angles to an imaginary vertical plane VP extending through the axis of rotation 36 of the wound paper roll 24 (FIG. 5). This is when the roll element is in its intermediate, or desired operational, position between the extremes of its rotational limits, designated $+\alpha$ and $-\alpha$ which are equal angles, as shown in FIG. 5, from the intermediate position, such as shown by an imaginary horizontal plane HP in FIG. 5. Plane HP, which extends through the axis 40 of wheel 30 and the pivot 33 of pivot arm 32, is perpendicular with plane VP.

Figure 3:
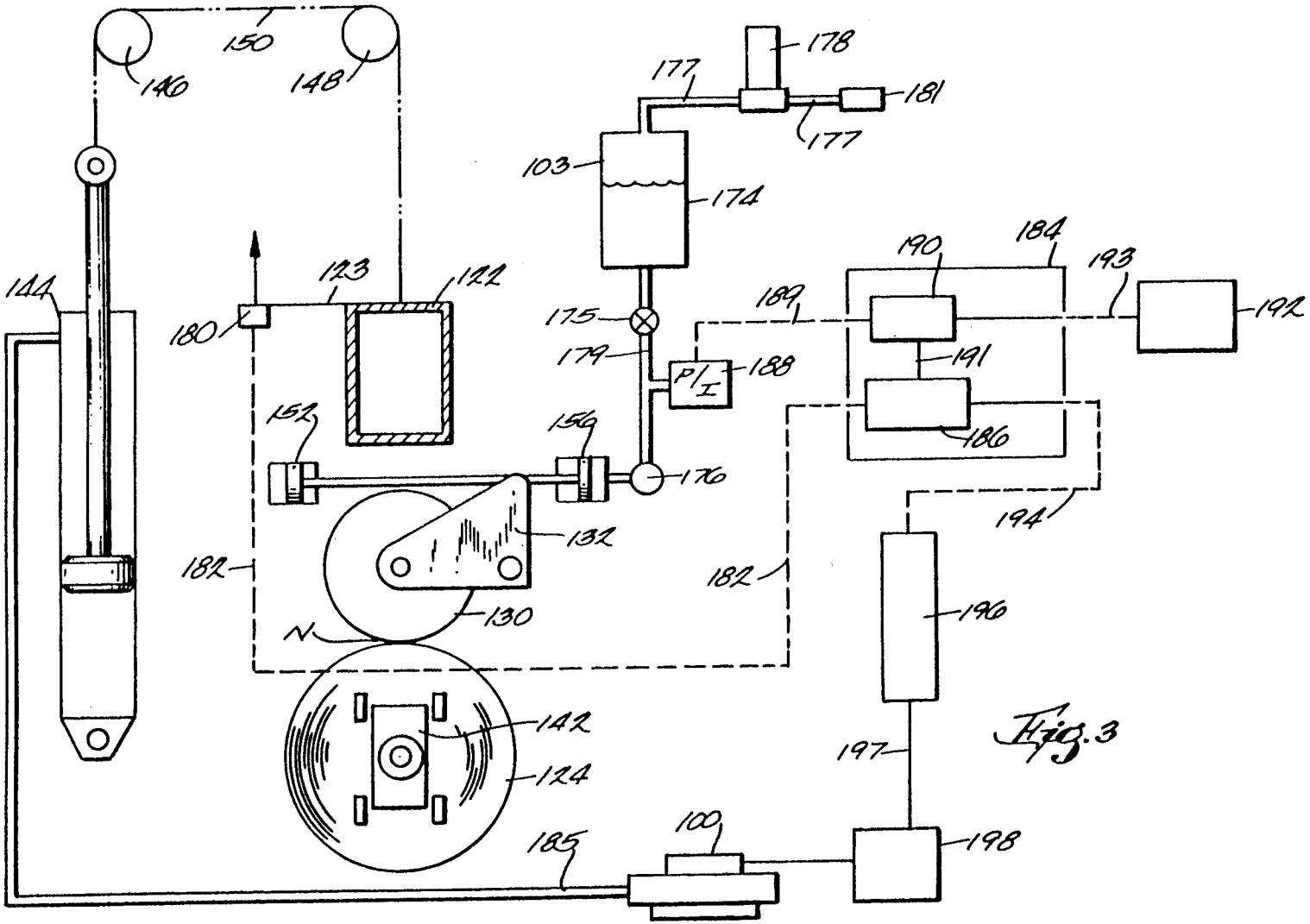
FIG. 3 is a schematic drawing of a single loop control system wherein the rider roll manifold valve 175 is closed and the nip loading is monitored and adjusted by moving the beam relative to the wound paper roll.

The beam is counter-balanced by a fluid cylinder. A typical arrangement is shown in FIG. 3 where a fluid cylinder 144 is linked with the top of the beam around a pair of guide pulleys 146,148 by a flexible cable, or chain, 150.

With reference to FIG. 5, in a preferred embodiment, a pneumatic counter-balance piston **52*a*, which is representative of a plurality of counter-balance pistons 52*a*,52*b*,52*c*, etc., is attached to the end of a control rod 54 opposite the load piston 56*a* which is connected to the other end of the control rod. Each counter-balance piston is biased against a corresponding load piston but is individually controllable through corresponding separate valves 63*a*,63*b*,63*c*, etc. The control rod is pivotally attached at 58 to the pivot arm 32. A source of high pressure air 60 is connected via line 62 to a selection valve 63 through a pair of throttling valves 64,66 which distribute air at predetermined pressures, such as 12 psi in line 68 from valve 64, and at a higher pressure, such as 60 psi, through line 70 from valve 66. The selection valve 63 can then be selectively moved to either position 63' where downstream line 65a is engaged with low pressure line 68 to provide a counter-balancing pneumatic pressure to load piston 56a to counter-balance the weight of the wheel element assembly or selection valve 63 can be moved to its alternate position 63" to shut off the low counter-balancing air pressure and introduce a relatively higher air pressure in downstream line 65a to the piston 52 to pivotally move the pivot arm 32** clockwise into a non-engagement, or lock-out, position when it is desired to not have that particular rider roll wheel assembly in operating position.

When the longitudinal length of the roll, or roll set, being wound becomes narrower in the cross-machine direction, the number of wheel elements needed in the composite rider roll becomes less. In such a situation, the selection valve 63 is moved to the high pressure position for the rider roll wheel elements which are not needed to contact with wound roll. When the high pressure air forces the wheel elements to a retracted position, some of the hydraulic fluid loading the load pistons is not needed and will be returned to a reservoir 74 which supplies the common manifold with hydraulic fluid. This will be explained in more detail below with respect to each of the pressure control and load control arrangements.

Similarly, and also with reference to FIG. 5, the plurality of load actuation pistons 56a,56b,56c, etc., can be made to communicate with, or be isolated from, reservoir 74 by positioning manifold selection valve 72 into its position 72",72', respectively. When it is desired to load the individual wheel elements, the manifold valve 72 is move into position 72" to connect the reservoir 74 containing hydraulic fluid via line 83 to the manifold 76, which is common to all of the hydraulic load pistons 56a,56b,56c, etc., via lines 73a,73b,73c, etc., to actuate each of the load pistons with equal hydraulic pressure to apply equal pressure forces against each of the corresponding wheel element pivot arms 32a,32b, 32c,32d, etc., which, in turn, pivot about their pivot points 33a,33b,33c,33d, etc., to provide corresponding equal nip loading forces along their individual nip lines of contact with the upper surface of the paper roll being wound.

The load piston 56a,56b,56c, etc., arrangement shown in FIG. 5 is common to both the position and load control types of systems where the mill air supply 81 is connected to an air pressure regulator 78 via line 77. Pressurized air, designated 103, 203, 303 in the apparatus shown in FIGS. 3, 6 and 7, respectively, is maintained above the surface of the hydraulic fluid in reservoir 74 from regulator 78 through line 71 so as to vary the hydraulic pressure in the load pistons as desired which, in the load control system, is according to an algorithm, as will be explained in more detail below.

With reference to FIG. 4, it can be seen that the individual wheel elements 30a,30b,30c,30d, etc., which are each relatively narrow in width along their substantially co-aligned axes of rotation, shown as 38 of the composite rider roll in FIG. 4, can move pivotally upwardly or downwardly to follow the localized changes in the surface contour (i.e. diameter) of the wound roll along its length caused by variations in the caliper of the paper produced during its manufacture. Some of the wheel elements 30b, 30c,30d are shown pivoted downwardly in dashed lines to illustrate this action.

Figure 6:
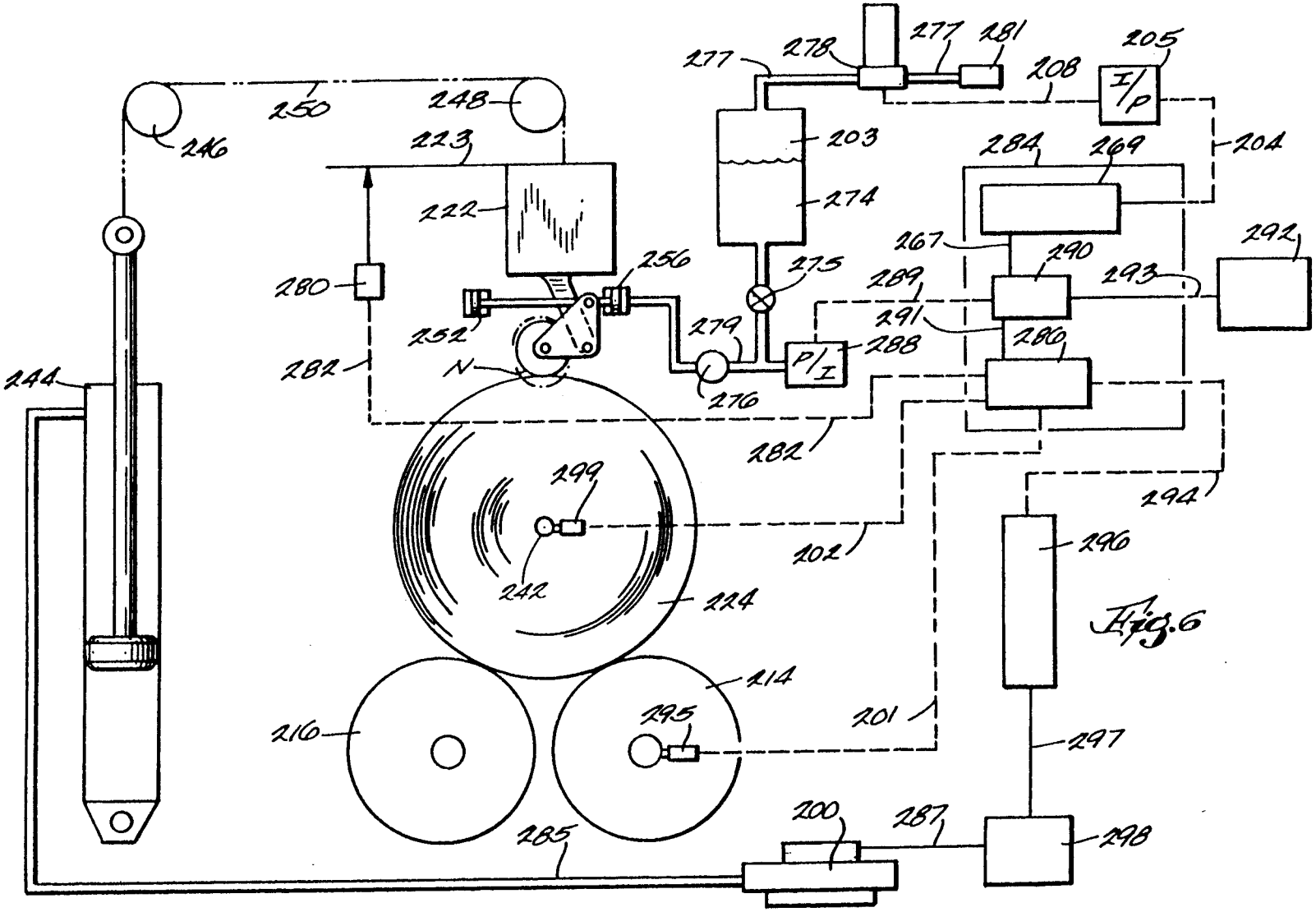
FIG. 6 is a schematic end view of a two-drum winder showing a load control system for monitoring and controlling the translational movement of the beam and for monitoring and controlling the hydraulic pressure loading the individual wheel elements, both as a function of the diameter of the paper roll being wound.
Figure 7:
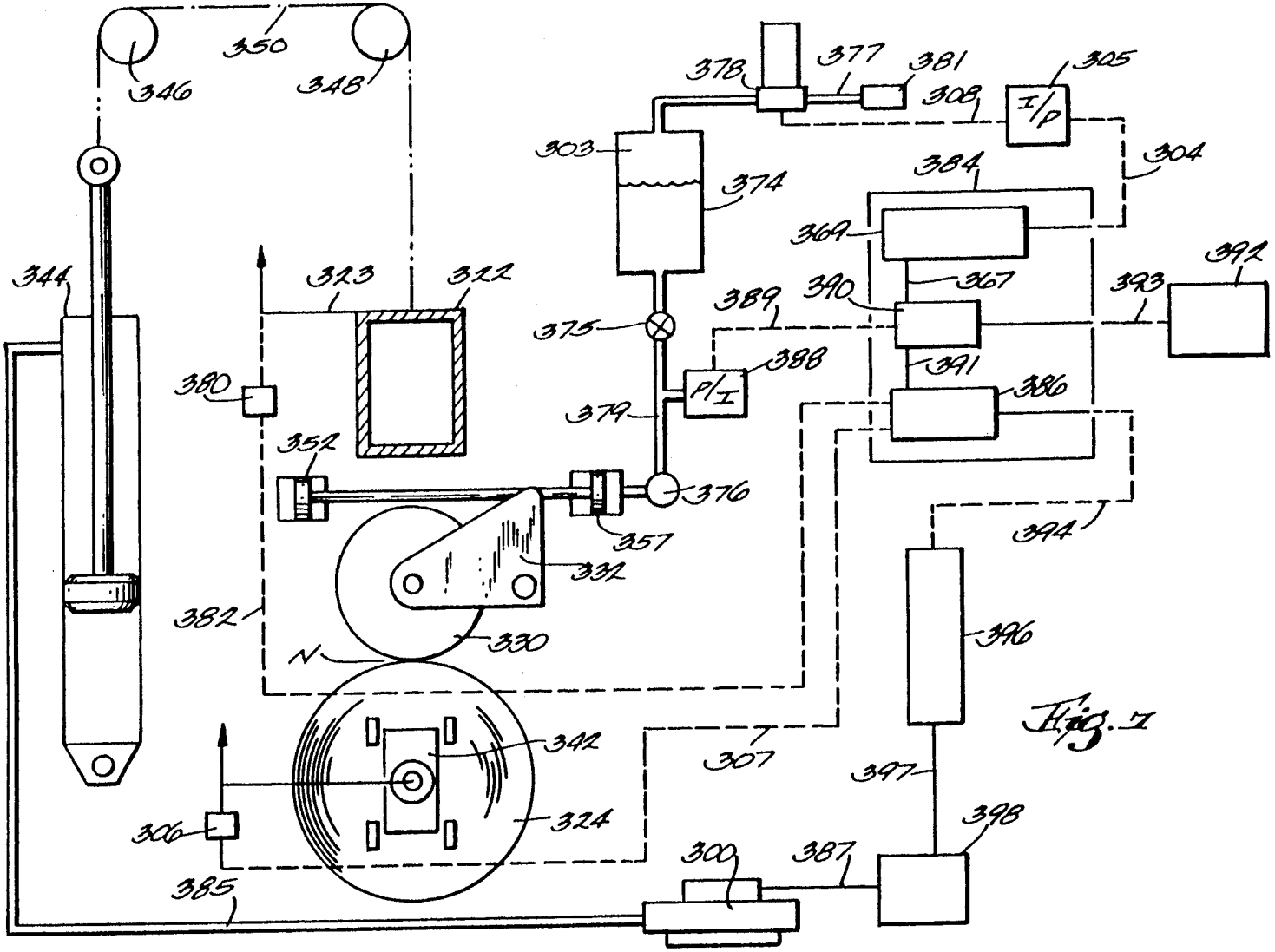
FIG. 7 is a schematic drawing of a double loop control system which is a modification of the control system in FIG. 3, in which valve 375 remains open for monitoring and controlling the support beam position and movement and the hydraulic pressure loading the rider roll wheel elements, both as a function of the wound paper roll diameter.

The three control schematics are shown in FIGS. 3, 6 and 7. Corresponding elements in each of these schematics will be correspondingly numbered, with a 100 series used in FIG. 3, a 200 series used in FIG. 6, and a 300 series in FIG. 7 to distinguish between them.

FIG. 3 illustrates a so-called single loop control system wherein the amount of hydraulic fluid required to actuate the number of individual wheel elements comprising the composite rider roll for a length equal to the length of the paper roll to be wound is introduced into the system from a reservoir 174 through a valve 175 and hydraulic line 179. An air pressure regulator 178 maintains a head of air pressure 103, from a source of high pressure air 181, via air line 177 over the hydraulic fluid in the reservoir to initially fill the system sufficiently to bring the active wheel elements to the midpoint of their travel. Valve 175 in the rider roll system is subsequently closed. When the valve 175 is closed, the hydraulic system is isolated with the hydraulic fluid in manifold 176 at a constant volume. Thus, the only control loop remaining is that controlling the rider roll beam position, hence the term "single loop control".

With continued reference to FIG. 3, some means, such as a position indicator 180, is mounted to the beam 122 at a known distance from a predetermined position or mark, such as top surface 123, and is connected via electrical line 182 to a Programmable Logic Controller (PLC) 184 having an Operator Interface Terminal (OIT) 186 where a profile of the desired nip load to be provided by the individual wheel elements comprising the composite rider roll for a computed paper roll diameter is programmed into the PLC. In other words, the desired nip load required to produce the best overall roll quality varies at different diameters of the paper roll during the winding process. The nip load is neither constant nor does it necessarily increase uniformly as the wound roll diameter increases. Thus, the profile of the desired nip load at different wound roll diameters is the result of years of observation and experience regarding the nip requirements to obtain a roll of paper which has a high quality sheet throughout the roll. Such nip load requirements vary with the grade of paper being wound and are influenced by other factors, such as the final diameter of the wound paper roll. The wound paper roll is supported in the winder with a core chuck 142 at either end thereof. The rider roll 130 engages the paper roll being wound along a substantially straight nip line of contact N on the upper surface of the paper roll. As the paper roll is wound and its diameter increases, the nip pressure of the individual articulated rider roll wheel elements, which are under the same hydraulic pressure due to their connection to the same manifold 176 and closed valve 175, increase the nip load against the wound paper roll due to the resistance of the beam against movement. Pressure transducer 188 indicates the hydraulic pressure in the load pistons 156 to the PLC via line 189. This pressure can be correlated by the PLC to nip load by scale 190 and converted to a nip readout in pounds per lineal inch (PLI) on a Digital Panel Meter (DPM) 192 via line 193.

In operation of the single loop control arrangement, the hydraulic pressure reading by transducer 188 is constantly compared with the programmed profile via line 191. When the growing wound roll increases the nip load, and consequently the hydraulic pressure in the sealed system (i.e. manifold 176 has been sealed by closed valve 175), as sensed by pressure transducer 188, this signal is compared with the programmed profile, which is a function of roll diameter as determined by either of the two methods previously described. If the resulting error signal falls outside the acceptable envelope, it is communicated via line 194 to a Proportional Integral Differential (PID) controller 196 which, in turn, signals an amplifier 198 via line 197. The amplifier signal via line 197 causes a hydraulic servo valve 100 to introduce hydraulic fluid via conduit 185 into a counter-balance cylinder 144 which retracts or extends the cable 150 to raise or lower the beam, thus correcting the load on the wound paper roll such that the hydraulic pressure in the rider roll manifold 176 reduces or increases the nip load against the wound paper roll to a desired force. This continues until the wound paper roll reaches the desired diameter, as computed by the PLC, and the operation is halted. The monitoring of the load piston hydraulic pressure and adjustment of the nip load via the beam position loop is continuous due to the continuous feedback through lines 182,189,191. In this regard, it is important to note that the signal line 182 (position feedback from the rider roll beam) does not play a part in control of the rider roll load. In this arrangement, the nip load along the length of the paper roll being wound is maintained at a substantially constant amount, and the constant amount is varied by positioning the beam as the paper roll diameter increases according to the profile programmed into the PLC. In other words, the nip load can be increased or decreased at various paper roll diameters according to the profile selected. The beam position loop comprises elements 123,180,182,186,191,194, 196,197,198,100,185,144,146,150,148 and 122.

When the cross-machine length of the wound roll set changes, either longer or shorter, since valve 175 is closed, the excess or deficient amount of hydraulic fluid needed in manifold 176 must be changed to allow the number of wheel elements to be positioned at their midpoints. This is due to the fact that more or less hydraulic fluid will be needed to fill the rider roll manifold with a corresponding more or less load pistons in operation with their associated wheel elements. The air pressure in the chamber 103 above the reservoir is used to fill the system with hydraulic fluid when the number of active wheel elements is increased. Conversely, when some wheel elements, and their associated load pistons, are taken out of service when shorter wound roll is to be wound, the air chamber 103 can accept excess hydraulic fluid when pertinent counter-balancing pistons 152 push the excess hydraulic fluid back out of the corresponding load pistons.

With reference to FIG. 6, a so-called double loop control system is utilized to control the nip load of the rider roll assembly against the paper roll being wound as a function of the diameter of the paper roll. A position indicator 280 is attached to the beam 222 to indicate the location of a mark, or surface, such as top surface 223 of the beam. The position indicator is linked with the Programmable Logic Controller (PLC) 284 by a line 282 to enable the PLC to monitor the beam position. Similarly, rotational counters 295,299 are connected to the winder drum 214 and core shaft chuck 242 of the paper roll, respectively, to monitor the length of the paper being wound into the paper roll and the rotation of the roll to signal the PLC via lines 201,202, respectively, where the diameter of the paper roll is calculated using this information. An Operator Interface Terminal (OIT) 286 is used to program a profile algorithm 269, in terms of desired nip load as a function of paper roll diameter, into the PLC. The PLC monitors the diameter of the paper roll and the position of the beam relative to the diameter of the paper roll and signals a Proportional Integral Differential controller 296 when the beam position varies from the desired beam position, as indicated by the wound roll diameter. This signal via line 294 is used by the PID to signal an amplifier 298 via line 297 to produce a signal corresponding to the deviation of the beam position from the desired beam position computed in the PLC according to the wound roll diameter as explained above. The signal from the amplifier 298 is passed through line 287 to a hydraulic servo valve 200 which either increases or decreases the hydraulic pressure in conduit 285 leading to a counter-balance cylinder 244 which operates to either retract or extend cable 250 to move the beam upwardly or downwardly relative to the paper roll being wound.

The pressure in the load pistons 256, which are connected to a common manifold 276 in the hydraulic pressure loop, is monitored by pressure transducer 288 which signals the PLC via line 289 and has its signal value displayed on Digital Panel Meter 292. This pressure information is also provided internally of the PLC to be used by the algorithm as shown by line 267. A source of hydraulic fluid in a reservoir 274 is maintained for the manifold 276 which supplies the load piston acting on each corresponding individual wheel element with hydraulic fluid at the same pressure. A regulator 278 is connected with a source of high pressure air 281 and maintains an air supply to chamber 20 above the surface of the hydraulic fluid in the reservoir under pressure. A signal line 204 leads from the PLC to a current/pressure instrument 205, which, in turn, controls regulator 278 by signals sent through line 208.

The set point signal to the current/pressure instrument 205 is determined by the algorithm in the OIT which incorporates the wound roll diameter information previously calculated, as explained above, to produce the set point signal. The algorithm produces the set point based upon calculations of the wound roll diameter done by a computer in the PLC. There is feedback to the rider roll pressure loop via line 204 from the pressure transducer 288 which sends signals through line 289 for comparison with the pressure corresponding to a particular rider roll nip load provided by the algorithm. The rider roll pressure loop comprises elements 269,204,205,208,281,277,278,203, 275,279,276,288,289,290 and 267. Valve 275 remains open and hydraulic fluid can flow into, and out of, manifold 276 to vary the nip load force of the rider roll wheel elements against the wound roll. Pressure transducer 288 is linked with the hydraulic pressure in the manifold via line 279. Transducer 288 then signals the PLC 284 via lines 289,267 to control the rider roll hydraulic pressure.

In operation of the double loop control arrangement, the beam distance relative to the wound paper roll diameter is maintained in a desired range via the continuous comparison of the signals received from the position indicator 280 and the calculations of the paper roll diameter determined via the signals from the rotational counters 295,299. In addition, the nip load provided by the load pistons **56*a*,56*b*,56*c*,56*d*, etc., is controlled from the set point determined by the algorithm in the OIT 286 of the nip load as a function of the paper roll diameter, and their nip load is adjusted upwardly or downwardly, via the current/pressure instrument 205**, according to the algorithm.

Thus, in the double loop control arrangement, the rider roll nip force is controlled by hydraulic pressure maintained by a control loop which may be either open or closed. The input algorithm defines a set point for rider roll nip load at any given point in time, and that set point is translated into hydraulic pressure by the current/pressure converter. This would represent open loop control of nip load. If a sensor 288 and line 289 are added by which the actual pressure and the set point pressure can be compared and corrections made, this would represent a closed loop system of nip load control. The hydraulic pressure required for a desired nip load by the rider roll wheel elements is then set, as desired, by the input algorithm as a function of the wound-in tension desired at a certain wound roll diameter. The nip load can, therefore, vary with the diameter of the wound roll, as desired, under control of the algorithm with or without feedback provided by signals from the pressure transducer.

Independent of the applied nip load, the beam position loop operates to maintain the position of the rider roll beam relative to the top of the wound paper roll necessary to maintain the several wheel elements at or near the center of their travel range. The beam position loop comprises the elements 223,280,282,286,294,296,297,298,287, 200,285,244,246,250,248,222.

In the event that more or less load pistons 256 are brought into service, or taken out of service, as required by the size of the set of rolls being wound, the retraction of the load pistons by the counter-balance pistons 252 will cause a flow of hydraulic fluid past open valve 275. The reservoir can thus readily adjust to the amount of hydraulic fluid needed in the manifold to maintain the pivoted rider roll wheel elements at their midpoint position. Thus, two control loops exist, one to control the nip load, the other to control rider roll beam position. Both control loops may be either open or closed.

With reference to the schematic control system shown in FIG. 7, the components and operation are essentially the same as that shown in FIG. 6 except that the core chuck position is used to compute the paper roll diameter from a position indicator 306 in the core chuck 342 supporting the wound paper roll. This signal is sent to the PLC via line 307. Thus, the comparison of the beam position relative to the paper roll diameter is made from signals via lines 382 and 307 based on the location of the beam and the location of the core chuck 342 at the center of the wound paper roll.

Both the profile of the desired wound paper roll in terms of web tension wound into the roll as a function of wound roll diameter, and the algorithm for varying the rider roll nip load as a function wound roll diameter are intended to serve as programmed instructions in the apparatus. They both serve as a guide to control the nip load of the articulated rider roll wheel elements based on the diameter of the wound roll at various stages of its development.

Thus, an articulated rider roll system for controlling the nip mechanics associated with winding a traveling web of paper into a wound roll has been disclosed which meets the objects and incorporates the features and advantages described. Naturally, variations in the equipment can be made without departing from the scope of the invention as defined by the appended claims. In this context, the embodiments shown are only exemplary, and it is to be understood that variations in the detail disclosed may be made within the spirit of the invention.

For example, the commercial embodiments of the various control and instrument units can be readily selected by one skilled in the winder art. In the expositive embodiments described in this application, the PLC (item 84) is a GE series VI controller, catalog number 1C600CR301A; the OIT (item 86) is a GE terminal, model number 1C600KD5103; the DPM (item 92) s a meter by RT Engineering Service, catalog number DPM-31; the I/P instrument (item 205) is a Fairchild converter, catalog number TP5223-4; the PID (item 96) is a Foxboro controller, model number 760CNA-AT; the amplifier (item 298) is a Wandfluh hydraulic servovalve controller, model number 1.109E2-B; and the hydraulic servo-valve (item 200) is a Wandfluh servovalve, model number AEDRV10-100-24VDC. Naturally, substitutions for these controls and instruments can be made to perform the functions and achieve the stated results in substantially the same manner.

Also, the term "articulated" is intended to include pivoted, as described above, as well as otherwise individually movable relative to the support beam and wound paper roll in the context of individual wheel elements.

Another example of a contemplated variation resides in eliminating signal lines 267 and 367 in the embodiments shown in FIGS. 6 and 7, respectively. This would make the rider roll hydraulic pressure loops open, like that in the embodiment shown in FIG. 3, instead of closed. The pressure reading supplied by the pressure transducers 288,388 would be for read-out purposes only; they would not be used by any algorithm for control purposes. The operation and rider roll wheel element nip load would be controlled by the beam position relative to the wound roll in a manner similar to that described in conjunction with the embodiment shown in FIG. 3. The would roll diameter and subsequent beam positioning would be controlled in the same manner as described in conjunction with the embodiments shown in FIGS. 6 and 7.

What is claimed is:

1. A rider roll system for applying nip loading force to a roll of paper being wound on a winder, said winder including at least one drum supporting the paper roll being wound about its axis of rotation, the system comprising:

a beam mounted on the winder for translational movement substantially vertically relative to the paper roll being wound;

moving means for moving the beam;

rider roll means, including a plurality of wheel elements, movably mounted to the beam and arranged to engage the surface of the paper roll substantially along a nip line of contact therewith along the length of the paper roll;

the wheel elements are each rotatably mounted in corresponding arm means, which arm means are pivotally mounted individually to the beam and are so arranged as to permit the wheel elements to contact the surface of the paper roll being wound substantially along a nip line of contact;

biasing means operatively linked with the rider roll means for providing substantially equal pressure force to each of the wheel elements to bias each of the wheel elements against the paper roll with substantially equal force;

control means, including diameter measurement means, for continuously monitoring and measuring the diameter of the paper roll and the position of the beam relative to the paper roll and for signaling the moving means to move the beam, at selected time intervals which are a function of the paper roll diameter, translationally relative to the paper roll a distance which is also a function of the paper roll diameter, whereby the nip force of the wheel elements against the wound paper roll is changed or maintained at a desired level along the nip line of contact.

2. A rider roll system as set forth in claim 1, wherein:

the biasing means includes a hydraulic manifold for supplying hydraulic fluid at the same pressure to each of a plurality of load pistons linked hydraulically in common with a hydraulic manifold, and operatively connected to corresponding ones of the wheel elements for loading the wheel elements into nipping engagement with the paper roll.

3. A rider roll system as set forth in claim 2, wherein:

the control means is operatively connected to the biasing means and controls the biasing means to change the hydraulic pressure force to the wheel elements as a function of the diameter of the paper roll being wound.

4. A rider roll system as set forth in claim 2, further including:

a reservoir means of hydraulic fluid linked with the hydraulic manifold for supplying hydraulic fluid to the hydraulic manifold;

valve means in fluid communication between the reservoir means of hydraulic fluid and the hydraulic manifold for selectively linking or isolating the reservoir means of hydraulic fluid to the hydraulic manifold, such that when the valve means is in its isolation position, the control means and biasing means are in an open loop mode where the amount of hydraulic fluid in the hydraulic manifold is maintained at a constant volume.

5. A rider roll system as set forth in claim 2, further including:

a reservoir means of hydraulic fluid for supplying hydraulic fluid to the hydraulic manifold;

a valve means in fluid communication between the reservoir means and the hydraulic manifold for selectively linking or isolating the reservoir means to the hydraulic manifold;

pressure transducer means operatively connected to the hydraulic manifold for detecting the hydraulic pressure therein, said pressure transducer means operatively linked with the control means for providing a signal thereto indicative of the hydraulic pressure in the hydraulic manifold;

the control means further includes programmed instruction means and a current/pressure instrument for signalling the reservoir means of hydraulic fluid to provide additional hydraulic fluid under pressure from the reservoir means to the hydraulic manifold through the valve means based on the pressure transducer signal in conjunction with the instruction means;

the valve means is operable such that when the valve means is in its hydraulic linking position, the reservoir means, hydraulic manifold, pressure transducer means, control means and the current/pressure instrument are in a closed loop mode for selectively varying the hydraulic pressure in the manifold.

6. A rider roll system for applying nip loading force to a roll of paper being wound on a winder, said winder including at least one drum supporting the paper roll being wound about its axis of rotation, the system comprising:

a beam mounted on the winder for translational movement substantially vertically relative to the paper roll being wound;

moving means for moving the beam;

rider roll means, including a plurality of wheel elements, movably mounted to the beam and arranged to engage the surface of the paper roll substantially along a nip line of contact therewith along the length of the paper roll;

the wheel elements are each rotatably mounted in corresponding arm means, which arm means are pivotally mounted individually to the beam and are so arranged as to permit the wheel elements to contact the surface of the paper roll being wound substantially along a nip line of contact;

biasing means operatively linked with the rider roll means for providing substantially equal pressure force to each of the wheel elements to bias each of the wheel elements against the paper roll with substantially equal nip force, the biasing means includes a hydraulic manifold for supplying hydraulic fluid at the same pressure to each of a plurality of load pistons linked hydraulically in common with the hydraulic manifold, and operatively connected to corresponding ones of the wheel elements for loading the wheel elements into nipping engagement with a paper roll;

the biasing means includes a pneumatic counter-balancing piston for each of the wheel elements, and which counter-balancing piston is linked in opposed array by a control rod to corresponding ones of the load pistons engaging each of the wheel elements, whereby the nip load of the load pistons is cushioned against bouncing forces caused by the dynamic motion of the rotating paper roll against the wheel elements;

control means, including diameter measurement means for continuously monitoring and measuring the diameter of the paper roll and the position of the beam relative to the paper roll and for signaling the moving means to move the beam, at selected time intervals which are a function of the paper roll diameter, translationally relative to the paper roll a distance which is also a function of the paper roll diameter, whereby the nip force of the wheel elements against the wound paper roll is changed or maintained at a desired level along the nip line of contact.

7. A rider roll system for applying nip loading force to a roll of paper being wound on a winder, said winder including at least one drum supporting the paper roll being wound about its axis of rotation, the system comprising:

a beam mounted on the winder for translational movement substantially vertically relative to the paper roll being wound;

moving means for moving the beam;

rider roll means, including a plurality of wheel elements, movably mounted to the beam and arranged to engage the surface of the paper roll substantially along a nip line of contact therewith along the length of the paper roll;

biasing means operatively linked with the rider roll means for providing substantially equal pressure force to each of the wheel elements to bias each of the wheel elements against the paper roll with substantially equal nip force, the biasing means including a rider roll pressure loop for supplying hydraulic fluid to each of the wheel elements for loading them at substantially the same nip force;

control means, including diameter measurement means, for continuously monitoring and measuring the diameter of the paper roll and the position of the beam relative to the paper roll and for signaling the moving means to move the beam, at selected time intervals which are a function of the paper roll diameter, translationally relative to the paper roll a distance which is also a function of the paper roll distance, the control means including a beam position indicator which is operatively associated with the diameter measurement means, and an instruction means for relating the desired nip load as a function of the wound paper roll diameter, and for determining the desired position of the beam relative to the wound paper roll and for sending signals to the moving means for moving the beam to a predetermined position based on the instruction means, whereby the nip force of the wheel elements against the wound paper roll is changed or maintained at a desired level along the nip line of contact;

a reservoir for supplying hydraulic fluid to the biasing means;

a controlled source of pressurized air for pressurizing the hydraulic fluid in the reservoir;

a current/pressure instrument for receiving a signal from the control means, based on the instruction means, and for producing a signal to the controlled source of pressurized air to vary the air pressure and the nip force according to the instruction means.

8. A rider roll system for applying nip loading force to a roll of paper being wound on a winder, said winder including at least one drum supporting the paper roll being wound about its axis of rotation, the system comprising:

a beam mounted on the winder for translational movement substantially vertically relative to the paper roll being wound;

moving means for moving the beam;

rider roll means, including a plurality of wheel elements, each wheel element movably mounted pivotally to the beam and arranged to engage the surface of the paper roll substantially along a nip line of contact therewith along the length of the paper roll;

control means, including diameter measurement means, for continuously monitoring and measuring the diameter of the paper roll and the position of the beam relative to the paper roll and for signaling the moving means to move the beam, at selected time intervals which are a function of the paper roll diameter, translationally relative to the paper roll a distance which is also a function of the paper roll diameter, the control means including a beam position indicator which is operatively associated with the diameter measurement means, and an instruction means for relating the desired nip load as a function of the wound paper roll diameter, and for determining the desired position of the beam relative to the wound paper roll and for sending signals to the moving means for moving the beam to a predetermined position based on the instruction means;

the instruction means comprises an algorithm for the desired wound paper roll;

biasing means operatively linked with the rider means for providing substantially equal pressure force to each of the wheel elements to load each of the wheel elements against the paper roll with substantially equal nip force, and including counter-balancing means linked with each of the wheel elements for providing counter-balancing force to each wheel element opposed to the pressure force;

transducer means for measuring the pressure force operating on each of the wheel elements and for providing a signal to the control means indicative of the pressure force;

a closed rider roll pressure loop connected with the transducer means and control means for selectively providing hydraulic pressure at different pressures, as desired, according to the algorithm to provide the nip force of the rider roll wheel elements against the wound paper roll.

9. A rider roll system for applying nip loading force to a roll of paper being wound on a winder, said winder including at least one drum supporting the paper roll being wound about its axis of rotation, the system comprising:

a beam mounted on the winder for translational movement substantially vertically relative to the paper roll being wound;

moving means for moving the beam;

rider roll means, including a plurality of wheel elements, each wheel element arranged to engage the surface of the paper roll substantially along a nip line of contact therewith along the length of the paper roll;

the wheel elements are each pivotally mounted, and the pivot for each of the wheel elements is located in a plane extending through the axis of rotation of the wheel element, and which plane is substantially perpendicular to the direction of translational movement of the paper roll as its diameter increases;

biasing means, including a plurality of load elements, each load element operatively linked with a source of hydraulic fluid, which is maintained in a rider roll manifold at a predetermined pressure, and each load element linked to a corresponding one of the wheel elements for providing equal pressure force to each of the wheel elements to bias each wheel element against the paper roll with substantially equal nip force;

control means, including diameter measurement means, for continuously monitoring and measuring the diameter of the paper roll, and beam position indicator means, for continuously monitoring the position of the beam relative to the paper roll and producing a beam signal, and a programmable logic controller means, for receiving a programmed instruction means of the desired beam position relative to the diameter of the paper roll during the winding process, and for receiving the beam signal for comparison with the instruction means and for producing a signal for controlling the actuation of the beam moving means as a function of the paper roll diameter according to the programmed instruction means, to move the beam a distance which is also a function of the paper roll diameter;

whereby the nip force of the rider roll wheel elements is controlled as a function of the wound paper roll diameter.

10. A rider roll system as set forth in claim 9, wherein:

the control means includes a pressure transducer operatively linked with the equal pressure provided by the biasing means to produce a pressure signal as a function of the equal pressure provided by the biasing means;

the programmed instruction means receiving the pressure signal for use in conjunction with the beam signal to produce a signal to control the actuation of the beam moving means to move the beam.

11. A rider roll system as set forth in claim 10, further including:

a proportional integral differential controller means for receiving the signal from the programmed instruction means and producing a signal to control the movement of the beam moving means.

12. A rider roll system for applying nip loading force to a roll of paper being wound on a winder, said winder including at least one drum supporting the paper roll being wound about its axis of rotation, the system comprising:

a beam mounted on the winder for translational movement substantially vertically relative to the paper roll being wound;

moving means for moving the beam;

rider roll means, including a plurality of wheel elements, each wheel element movably mounted to the beam and arranged to engage the surface of the paper roll substantially along a nip line of contact therewith along the length of the paper roll;

the wheel elements are pivotally mounted individually to the beam;

biasing means, including a plurality of load elements, each load element operatively linked with a source of hydraulic fluid, which is maintained in a rider roll manifold at a predetermined pressure, and each load element linked to a corresponding one of the wheel elements for providing equal pressure force to each of the wheel elements to bias each wheel element against the paper roll with substantially equal nip force;

control means, including diameter measurement means, for continuously monitoring and measuring the diameter of the paper roll, and beam position indicator means, for continuously monitoring the position of the beam relative to the paper roll and producing a beam signal, and a programmable logic controller means for receiving instruction means relating the beam position relative to the diameter of the paper roll during the winding process, said logic controller means receiving the beam signal, the diameter measurement means includes rotation means for measuring the rotation of the wound paper roll and the rotation of one support drum, which rotation means are operatively linked with the programmable logic controller means to compute the diameter of the wound paper roll for comparison with the instruction means and for producing a signal for controlling the actuation of the beam moving means, as a function of the paper roll diameter according to the instruction means, to move the beam a distance which is also a function of the paper roll diameter;

whereby the nip force of the rider roll wheel elements is controlled as a function of the wound paper roll diameter.

13. A rider roll system method for applying nip loading force to a roll of paper being wound on a winder, said winder including at least one drum supporting the paper roll being wound about its axis of rotation, a beam mounted for translational movement in the winder substantially vertically relative to the paper roll, a control means for receiving programmed instructions regarding desired nip force, beam position and wound paper roll diameter, the method comprising the steps:

engaging the upper surface of the paper roll with a plurality of substantially axially aligned rider roll wheel elements which are individually mounted on the beam and individually movable relative thereto;

applying the same hydraulic pressure from a common source of hydraulic fluid pressure to load each of the wheel elements to cause them to produce an equal nip force against the paper roll;

providing a first signal to the control means indicative of the hydraulic pressure applied to the plurality of wheel elements;

counter-balancing the nip load force applied by each of the wheel elements;

monitoring the position of the beam;

providing a feedback signal to the control means indicative of the beam position;

computing the diameter of the paper roll;

determining the desired position of the beam relative to the wound paper roll, based on the instructions in the control means and the feedback signal, to provide the desired nip force;

sending a second signal from the control means to a means including a moving means for moving and biasing the beam according to the instructions.

14. A rider roll system method for applying nip loading force to a roll of paper being wound, as set forth in claim 13, wherein:

the hydraulic pressure applied to each of the wheel elements is selectively variable and supplied through a closed rider roll pressure loop to produce a nip load force on the paper roll;

the control means includes an algorithm programmed with the desired nip force as a function of the paper roll diameter;

the control means compares the paper roll diameter with the desired nip load according to the algorithm and changes nip load force accordingly.

15. A rider roll system method for applying nip loading force to a roll of paper being wound, as set forth in claim 13 wherein:

the hydraulic fluid pressure applied to the rider roll wheel elements is supplied by a closed pressure roll loop at a selected pressure which is maintained at the selected level;

the programmed instructions include an algorithm of desired nip load as a function of wound paper roll diameter;

and further including the steps:

comparing the first signal with the programmed algorithm of the nip force as a function of the wound paper roll diameter;

adjusting the second signal from the control means to actuate the moving means based on the beam position and the nip force at a computed diameter of the wound paper roll to provide the desired nip force.

16. A rider roll system method for applying nip loading force to a roll of paper being wound, as set forth in claim 15, further including the step of:

comparing the third signal with the algorithm and adjusting the hydraulic fluid pressure supplied by the pressure roll loop according to the algorithm.

* * * * *

UNITED STATES PATENT AND TRADEMARK OFFICE

CERTIFICATE OF CORRECTION

PATENT NO. : 5,320,299

DATED : June 14, 1994

INVENTOR(S) : Donald C. Fitzpatrick; Kenneth G. Frye; Donald Gangemi; Alexis Olshansky It is certified that error appears in the above-indentified patent and that said Letters Patent is hereby corrected as shown below:

| | |
|---|---|
| Column 10, Line 35: | Please delete "20" and insert ---203--- in place thereof. |
| Column 12, Line 13: | Immediately after "(item 92)", please delete "s" and insert ---is--- in place thereof. |
| Column 15, Line 20: | Please delete "distance" and insert ---diameter--- in place thereof. |

Signed and Sealed this

Sixth Day of September, 1994

*Attest:*

*Attesting Officer*

Bruce Lehman

BRUCE LEHMAN

*Commissioner of Patents and Trademarks*